US012656085B2

(12) United States Patent
Boudreau et al.

(10) Patent No.: US 12,656,085 B2
(45) Date of Patent: Jun. 16, 2026

(54) TARGET SIGHT

(71) Applicant: Sig Sauer, Inc., Newington, NH (US)

(72) Inventors: Christopher J. Boudreau, Estacada, OR (US); John P. Nichols, Tigard, OR (US); Richard B. Brumfield, Athens, AL (US); Gregory S. Smith, Canton, GA (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 19/352,342

(22) Filed: Oct. 7, 2025

(65) Prior Publication Data

US 2026/0036400 A1 Feb. 5, 2026

Related U.S. Application Data

(63) Continuation of application No. 18/962,864, filed on Nov. 27, 2024, which is a continuation of application No. 18/078,780, filed on Dec. 9, 2022, now abandoned.

(60) Provisional application No. 63/287,875, filed on Dec. 9, 2021.

(51) Int. Cl.
*F41G 11/00* (2006.01)
*F41G 1/26* (2006.01)

(52) U.S. Cl.
CPC ..... *F41G 11/001* (2013.01); *F41G 1/26* (2013.01)

(58) Field of Classification Search
CPC ..... F41G 11/001; F41G 11/26
USPC ..... 42/124
See application file for complete search history.

(56) References Cited

U.S. PATENT DOCUMENTS

| | | | | |
|---|---|---|---|---|
| 9,651,337 | B1 | 5/2017 | Curry et al. | |
| 10,024,628 | B2 | 7/2018 | Toner et al. | |
| 10,753,710 | B2 | 8/2020 | Niswander et al. | |
| 10,871,350 | B1 | 12/2020 | Thomas et al. | |
| 11,002,517 | B1 | 5/2021 | Holly | |
| 11,112,214 | B2 | 9/2021 | Niswander et al. | |
| 11,313,646 | B1 | 4/2022 | Simon | |
| 11,428,484 | B2 | 8/2022 | Bachstein et al. | |
| 11,460,274 | B2 * | 10/2022 | Dawson, Jr. | F41G 11/001 |
| 11,644,280 | B2 * | 5/2023 | Langdon | F41G 1/16 29/401.1 |
| 11,933,583 | B2 * | 3/2024 | Niswander | F41G 11/001 |
| 12,253,334 | B2 * | 3/2025 | Dawson, Jr. | F41G 11/001 |
| 12,449,233 | B1 * | 10/2025 | Schmidt | F41G 1/30 |
| 12,467,717 | B2 * | 11/2025 | Sheets, Jr. | F41G 1/30 |
| 2015/0198415 | A1 | 7/2015 | Campean | |
| 2017/0059277 | A1 | 3/2017 | Justice | |

(Continued)

*Primary Examiner* — Samir Abdosh

(74) *Attorney, Agent, or Firm* — Miller Nash LLP

(57) ABSTRACT

A target sight for a firearm includes a lip on a front end of the target sight configured to be inserted into a mating slot of a receiving portion of the firearm, a bottom surface configured to interface with the receiving portion of the firearm, a first feature extending from the bottom surface configured to interface with the receiving portion of the firearm, a second feature extending from the bottom surface configured to interface with the receiving portion of the firearm, a rear landing on a rear end of the target sight opposite the front end, an iron sight configured to sit on the rear landing, and at least one fastener structured to clamp the rear landing between the iron sight and the firearm, thereby securing the target sight to the firearm.

29 Claims, 5 Drawing Sheets

(56) References Cited

U.S. PATENT DOCUMENTS

| | | | | |
|---|---|---|---|---|
| 2018/0087871 | A1 | 3/2018 | Toner et al. | |
| 2018/0195835 | A1 | 7/2018 | Crispin et al. | |
| 2019/0257620 | A1 | 8/2019 | Zimmer | |
| 2019/0331461 | A1 | 10/2019 | Zimmer | |
| 2020/0025520 | A1 | 1/2020 | Niswander et al. | |
| 2020/0326157 | A1 | 10/2020 | Curry | |
| 2021/0018298 | A1 | 1/2021 | Wingfield | |
| 2021/0025673 | A1 | 1/2021 | Niswander et al. | |
| 2021/0222978 | A1 | 7/2021 | Bachstein et al. | |
| 2021/0254933 | A1 | 8/2021 | Langdon | |
| 2021/0270572 | A1* | 9/2021 | Dawson, Jr. | F41G 11/001 |
| 2022/0136801 | A1 | 5/2022 | Niswander et al. | |
| 2023/0083029 | A1 | 3/2023 | Kilic | |
| 2023/0117500 | A1 | 4/2023 | Dawson, Jr. | |
| 2023/0184516 | A1* | 6/2023 | Boudreau | F41G 11/004 42/124 |
| 2023/0213315 | A1 | 7/2023 | Planck et al. | |
| 2025/0283693 | A1* | 9/2025 | Sheets, Jr. | F41G 11/001 |
| 2025/0283694 | A1* | 9/2025 | Sheets, Jr. | F41G 11/001 |

* cited by examiner

TARGET SIGHT

CROSS REFERENCE TO RELATED APPLICATIONS

This application is a continuation of U.S. non-provisional patent application Ser. No. 18/962,864, entitled "REFLEX TARGET SIGHT MOUNT," filed Nov. 27, 2024, which is a continuation of U.S. non-provisional patent application Ser. No. 18/078,780, entitled "TARGET SIGHT MOUNT," filed Dec. 9, 2022, which claims benefit of U.S. provisional patent application No. 63/287,875, entitled "TARGET SIGHT MOUNT," filed Dec. 9, 2021, the disclosures of all of which are incorporated herein by reference in their entirety.

FIELD OF THE INVENTION

This disclosure is directed to targeting sights, and, more particularly, to a mounting system for targeting sights.

BACKGROUND

Reflex type gun sights, also commonly referred to as red-dot sights, provide a shooter a quick and easy way to sight a target compared to conventional iron sights. Reflex sights are optical sights that include a partially reflecting element on which an aiming light or target is projected. An LED or other light emitter is commonly used as the light source. When the emitter generates its light signal, the projected light reflects from the reflecting element of the reflex sight, such as a lens or other optic, and the reflection is seen by the shooter as being superimposed on the target or field of view. This reflection is referred to as a Point of Aim (PoA). In operation, the shooter then aligns the target to the PoA to accurately aim the firearm at the target.

Modern reflex sights are typically secured to a mounting plate, which is a part separate from the reflex sight and the firearm itself. This mounting plate, in turn, is affixed to the firearm. On a pistol, typically the mounting plate is secured to the slide. Thus, the mounting plate is secured to the slide, and then the reflex sight is secured to the mounting plate. Since the slide moves relative to the pistol frame when a cartridge is loaded into the pistol firing chamber, the slide incurs a relatively large amount of movement during repetitive use. This repetitive movement can cause the mounting plate to become loose or dislodged, which then causes the reflex sight to no longer be securely mounted to the firearm. When a reflex sight is not securely mounted, the reflex sight may also move while the firearm is in use, which, in turn, may move the PoA during use and diminish the performance of the reflex sight.

Embodiments of the invention address these and other limitations of present sights.

DESCRIPTION

Embodiments disclosed herein include a target sight that may be positioned directly on a pistol slide and secured in place, without the use of a mounting plate. In embodiments, the target sight interfaces with the pistol slide via multiple points of contact, securing the target sight in a mounting position and preventing loosening or dislodging of the target sight while the firearm is in use.

Figure 1:
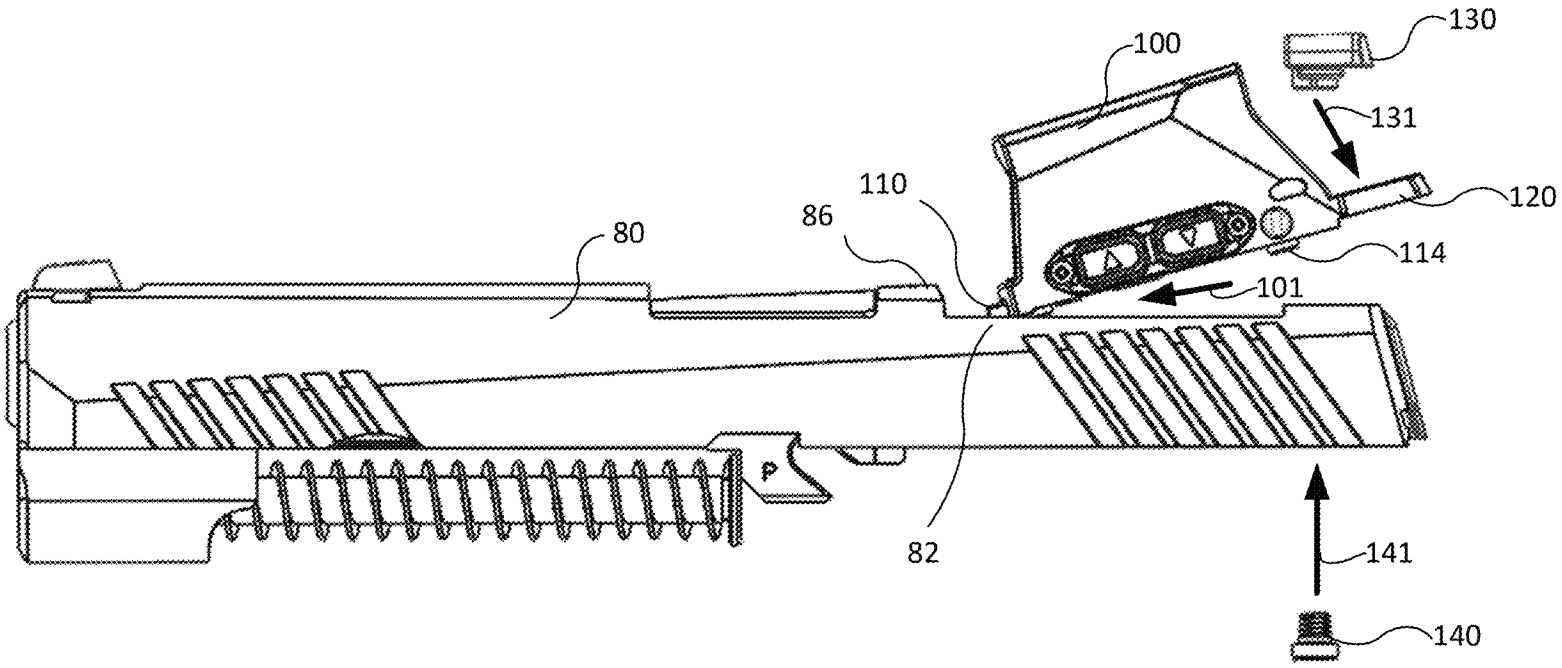
FIG. 1 is a side view of a pistol slide including a target sight mount and an interfacing target sight according to embodiments of the invention.

FIG. 1 is a side view illustration of a target sight 100 being mounted to a pistol slide 80 having a receiving portion 82. As described below, the target sight 100 may be securely mounted to the pistol slide 80 without the use of any mounting plate. The target sight 100 and pistol slide 80 include multiple interface points through which the target sight may be securely mounted to the pistol slide. Further, in the illustrated embodiment, only one of the interface points between the pistol slide 80 and the target sight 100 uses a fastening piece, which in some embodiments is a single mounting screw. The remaining interface points utilize features of the target sight 100 and pistol 80 themselves. As such, mounting and dismounting the target sight is quick and easy to perform, even in the field, as mounting the target sight does not require special tools or separate parts.

As seen in FIG. 1, the pistol slide 80 includes a relatively flat receiving portion 82 at which the target sight 100 is mounted. The target sight 100 includes a front lip 110 and a rear landing 120, the functions of which are described in further detail below. The target sight 100 may also include an optional iron sight 130. As described in detail below, to mount the target sight 100 to the pistol slide 80, the user first moves the sight into position, as shown by positioning arrow 101. As the sight 100 is moved into position, the front lip 110 is inserted into a mating slot 86 formed in the slide 80. The mating slot 86 is shown in more detail below. Then the user inserts a fastening screw 140 through the bottom of the slide, illustrated by positioning arrow 141. The fastening screw 140 passes through an aperture in the rear landing 120 and into a threaded portion of the iron sight 130, which, during installation, is brought proximate the rear landing as shown by positioning arrow 131. Tightening the fastening screw 140 clamps the screw head, pistol slide 80, and the iron sight 130 together, securely holding the target sight 100 to the pistol slide 80. The front portion of the sight 100 is held to the slide by the mechanical interference of the front lip 110 and the mating slot 86, while the rear portion of the sight 100 is held to the slide 80 by the fastening screw 140. Additional points of contact, described below, also help to index the target sight 100 to the receiving portion 82 of the pistol slide 80 and prevent movement of the target sight after mounting. Also, although, in the illustrated embodiment the target sight 100 is clamped into place by a fastening screw 140, other forms of attachment may be possible, such as a holding pin or other type of clamp.

Although the embodiments illustrated herein show the accessory mounted to a pistol slide, the accessory may be mounted to any type of firearm.

Figure 2:
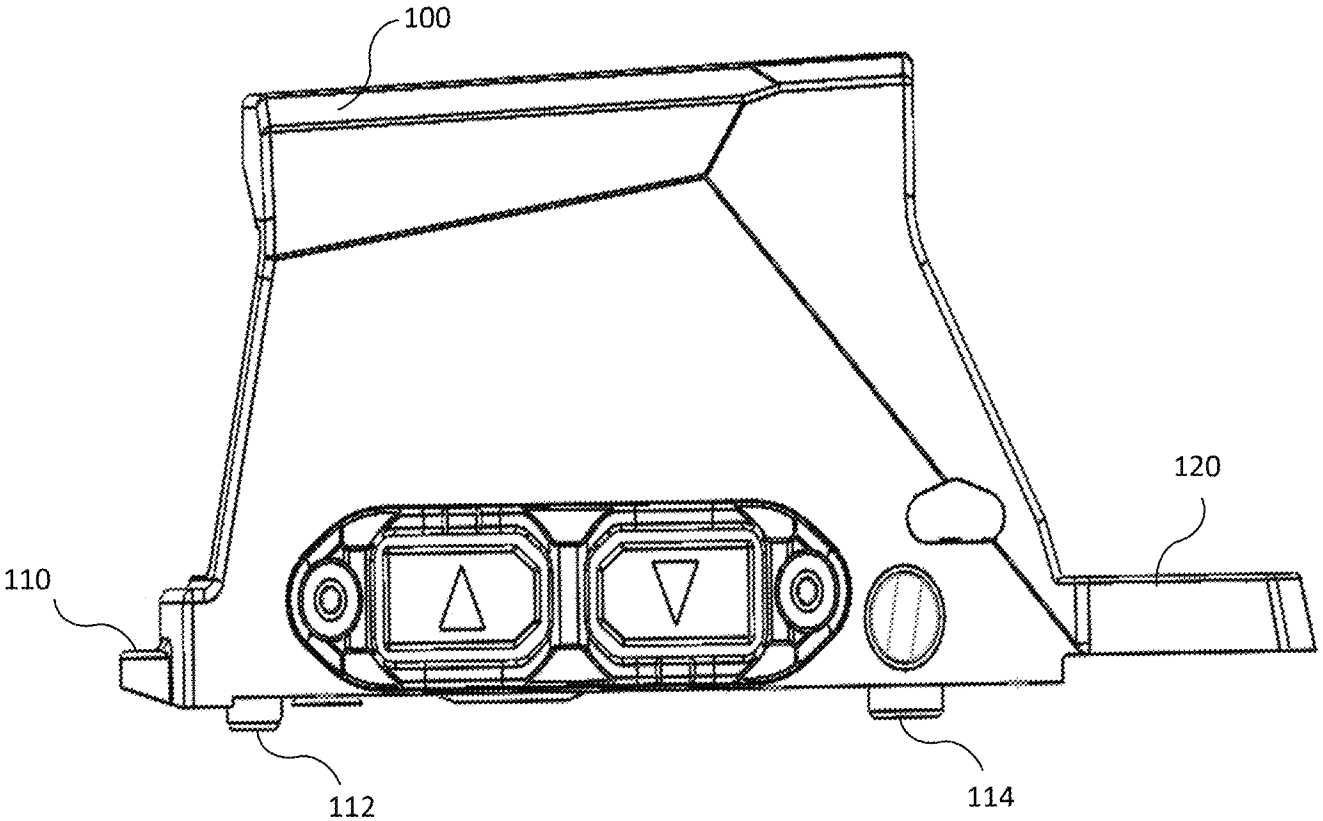
FIG. 2 is side view of the target sight of FIG. 1 illustrating attachment points, according to embodiments of the invention.

FIG. 2 is a detailed side view of the target sight 100, further illustrating examples of the front lip 110 and rear landing 120. Additionally illustrated are two index pins, 112, 114, included in embodiments of the target sight 100. As more fully described with reference to FIGS. 4-6, these index pins 112, 114 are received in index holes in the receiving portion 82 of the slide 80 to provide indexing of the sight 100 to the slide 80, as well as providing additional points of contact between the sight and the slide.

Figure 3:
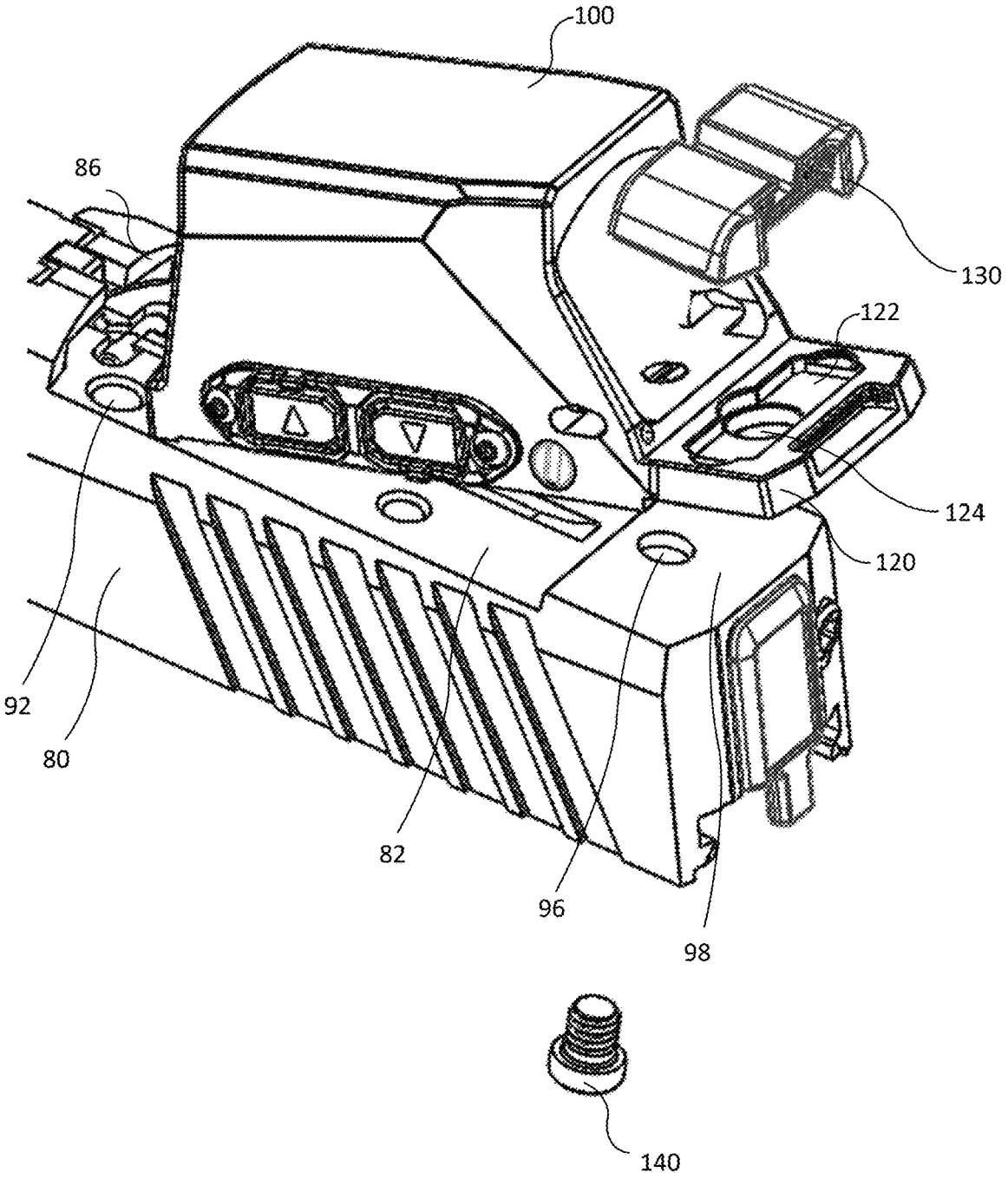
FIG. 3 is a perspective view of the pistol slide and target sight of FIG. 1 according to embodiments of the invention.

FIG. 3 illustrates additional components of the target sight mount according to embodiments. In this figure, an index hole 92 the slide 80 is illustrated. The index hole 92 receives the index pin 112, illustrated in FIG. 2, of the target sight 100, and, once the target sight 100 is secured, prevents movement of the target sight relative to the slide 80. Also illustrated in FIG. 3 are apertures 96 in the slide 80 and 124 through the rear landing 120 of the target sight 100. When mounting the sight 100 to the slide 80, the fastening screw 140 is inserted through the bottom of the slide 80 through both of these apertures 96, 124, and into a threaded receiver of the iron sight 130. In embodiments that do not include the iron sight 130, a special nut or other threaded insert may receive and secure the fastening screw 140, providing the clamping force. In yet other embodiments, the rear landing 120 includes a threaded portion in place of the aperture 124, into which the fastening screw may be inserted. Tightening the fastening screw 140 causes the clamping force, described above, which secures the target sight 100 to the slide 80.

The iron sight 130 may sit in a recess 122, which accepts a mating surface of the iron sight 130, further increasing surface area to distribute the clamping force caused by the fastening screw 140 over a rear landing 98 of the slide 80. As discussed, embodiments that do not include the iron sight 130 may instead include a special nut or other threaded receiver that may sit in the recess 122. In other words, in some embodiments, the iron sight 130 includes a threaded receiver, but this threaded receiver function may be provided by another device and need not strictly be included within the iron sight.

Figure 4:
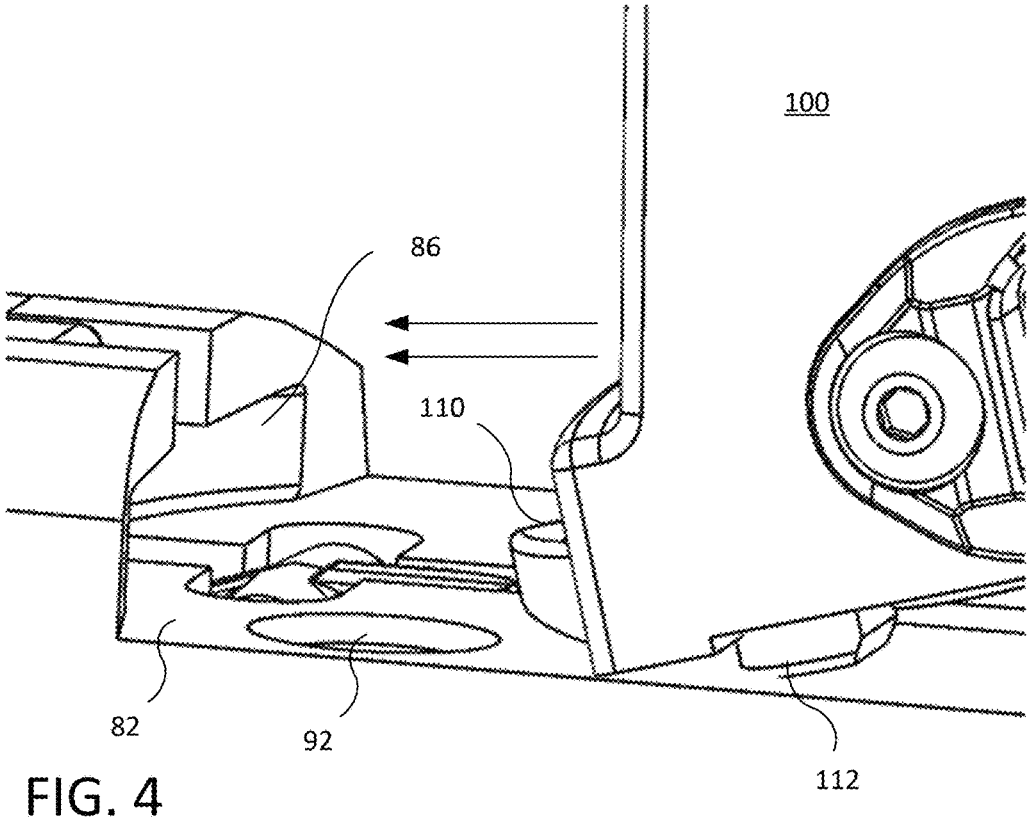
FIG. 4 is a perspective view of the target sight of FIG. 1 being inserted the pistol slide according to embodiments of the invention.

FIG. 4 details how the target sight 100 is mounted to the receiving portion 82 of the slide 80. As illustrated, the target sight 100 is moved forward into its mounting position on the slide 80, and the front lip 110 is inserted into the mating slot 86 formed at one end of the receiving portion 82 of the slide 80. The front lip 110 securely fits within the mating slot 86 when the target sight 100 is moved fully into its mounting position, securing the target sight 100 to the slide 80 at this respective end of the receiving portion 82. Also illustrated in FIG. 4 is the index pin 112 of the target sight 100, which is also inserted into the corresponding index hole 92 on the receiving portion 82 of the slide 80 as the target sight 100 is moved into its mounting position. When the target sight 100 is in its mounting position, the index pin 112 is fully received into the index hole 92, further securing the target sight 100 to the slide 80 at an additional point on the target sight 100 different from the lip 110.

Figure 5:
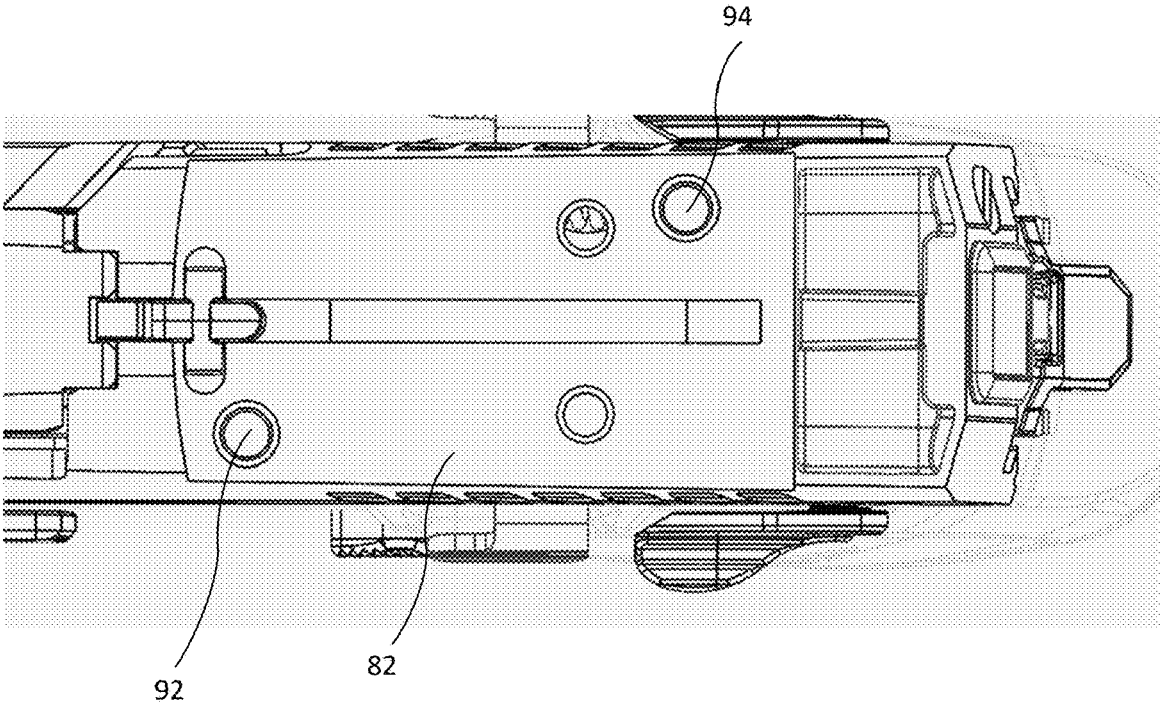
FIG. 5 is a top view of a mounting portion of the pistol slide according to embodiments.
Figure 6:
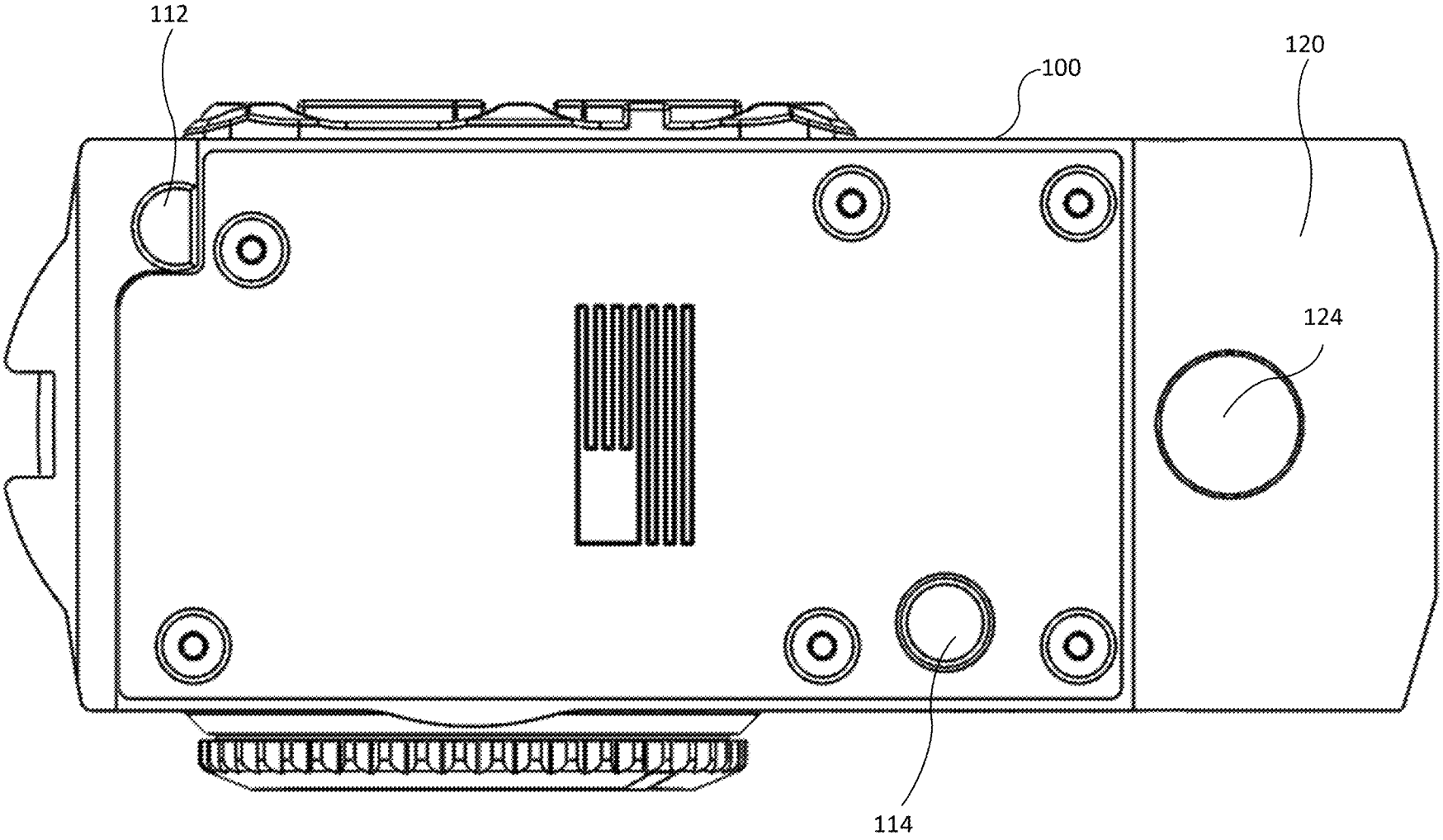
FIG. 6 is a bottom view of the target sight of FIG. 1 according to embodiments.

In some embodiments, the target sight 100 includes more than one index pin. As illustrated in FIGS. 5 and 6, an embodiment of the target sight 100 includes two index pins 112, 114, which are longitudinally and laterally offset from one another. In such embodiments, as the target sight 100 is moved forward into its mounting position on the receiving portion 82, the index pins 112, 114 may be simultaneously inserted into the corresponding index holes 92, 94 on the receiving portion 82 of the slide 80. When the target sight 100 is in its mounting position, these index pins 112, 114 are fully received in index holes 92, 94, securing the target sight 100 in its mounting position at multiple points along the slide 80. Then the fastening screw 140 (not illustrated) is inserted into the aperture 124 to be received by the iron sight 130 or other threaded receiver.

In some embodiments, the target sight 100 includes four points of contact to the receiving portion 82 to securely mount the target sight 100 to the slide 80. The first of these contact points is the front lip 110, which is received by the mating slot 86, and the second and third of these contact points are the index pins 112, 114, which are respectively received by the index holes 92, 94. Finally, the fastening screw 140 securely clamps the target sight 100 to the receiving portion 82 of the slide 80, serving as the fourth contact point. These multiple points of contact work in cooperation to provide mechanical engagement of the target sight 100 to the slide 80 at multiple locations on the target sight 100, maintaining the target sight 100 in its mounting position while the firearm is in use.

In other embodiments, more or fewer contact points may be used. For example, the target sight 100 may include additional index pins in various arrangements, and the receiving portion 82 of the slide 80 may include additional index holes to accept such pins.

The previously described versions of the disclosed subject matter have many advantages that were either described or would be apparent to a person of ordinary skill. Even so, all of these advantages or features are not required in all versions of the disclosed apparatus, systems, or methods. All features disclosed in the specification, and all the steps in any method or process disclosed, may be combined in any combination, except combinations where at least some of such features and/or steps are mutually exclusive. Each feature disclosed can be replaced by alternative features serving the same, equivalent, or similar purpose, unless expressly stated otherwise.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "vertical," "horizontal," "right," "left," "upward," and "downward" are used for convenience and in reference to the views provided in figures. But the target sight and components thereof may have a number of orientations in actual use. Thus, a feature that is vertical, horizontal, to the right, or to the left in the figures may not have that same orientation or direction in actual use.

We claim:

1. A target sight for a firearm, the target sight comprising:

a lip on a front end of the target sight, the lip configured to be inserted into a mating slot of a receiving portion of the firearm;

a bottom surface configured to interface with the receiving portion of the firearm;

a first feature extending from the bottom surface of the target sight and configured to interface with the receiving portion of the firearm, the first feature near a left side of the target sight;

a second feature extending from the bottom surface of the target sight and configured to interface with the receiving portion of the firearm, the second feature near a right side of the target sight opposite the left side;

a rear landing on a rear end of the target sight opposite the front end;

an iron sight configured to sit on the rear landing; and at least one fastener structured to clamp the rear landing between the iron sight and the firearm, thereby securing the target sight to the firearm, wherein the target sight is secured to the firearm without the use of a mounting plate.

2. The target sight according to claim 1, wherein the front end of the target sight is held to the firearm by mechanical interference of the lip and the mating slot.

3. The target sight according to claim 1, wherein the first and second features help to index the target sight to the receiving portion of the firearm.

4. The target sight according to claim 1, wherein the firearm is a pistol having a slide with the receiving portion.

5. The target sight according to claim 4, wherein the receiving portion is relatively flat.

6. The target sight according to claim 1, wherein a mating surface of the iron sight to the rear landing increases surface area to distribute clamping force caused by the at least one fastener over the rear landing.

7. The target sight according to claim 1, wherein the iron sight includes at least one threaded receiver for the at least one fastener.

8. The target sight according to claim 1, wherein the lip is inserted into the mating slot of the receiving portion of the firearm by moving the target sight forward relative to the receiving portion.

9. The target sight according to claim 8, wherein, when the target sight is moved forward relative to the receiving portion, the first and second features are simultaneously inserted into corresponding features of the receiving portion.

10. The target sight according to claim 1 further comprising a light emitter structured to generate a point of aim.

11. A firearm including the target sight of claim 1.

12. A firearm, comprising:

a receiving portion; and a target sight including:

a lip on a front end of the target sight, the lip configured to be inserted into a mating slot of the receiving portion of the firearm;

a bottom surface configured to interface with the receiving portion of the firearm;

a first feature extending from the bottom surface of the target sight and configured to interface with the receiving portion of the firearm, the first feature near a left side of the target sight;

a second feature extending from the bottom surface of the target sight and configured to interface with the receiving portion of the firearm, the second feature near a right side of the target sight opposite the left side;

a rear landing on a rear end of the target sight opposite the front end;

an iron sight configured to sit on the rear landing; and at least one fastener structured to clamp the rear landing between the iron sight and the firearm, thereby securing the target sight to the firearm, wherein the target sight is secured to the firearm without the use of a mounting plate.

13. The firearm according to claim 12, wherein the front end of the target sight is held to the firearm by mechanical interference of the lip and the mating slot.

14. The firearm according to claim 12, wherein the first and second features help to index the target sight to the receiving portion of the firearm.

15. The firearm according to claim 12, wherein the firearm is a pistol having a slide with the receiving portion.

16. The firearm according to claim 15, wherein the receiving portion is relatively flat.

17. The firearm according to claim 12, wherein a mating surface of the iron sight to the rear landing increases surface area to distribute clamping force caused by the at least one fastener over the rear landing.

18. The firearm according to claim 12, wherein the iron sight includes at least one threaded receiver for the at least one fastener.

19. The firearm according to claim 12, wherein the lip is inserted into the mating slot of the receiving portion of the firearm by moving the target sight forward relative to the receiving portion.

20. The firearm according to claim 12, wherein, when the target sight is moved forward relative to the receiving portion, the first and second features are simultaneously inserted into corresponding features of the receiving portion.

21. The firearm according to claim 12, wherein the target sight includes a light emitter structured to generate a point of aim.

22. A target sight for a firearm, the target sight comprising:

a lip on a front end of the target sight, the lip configured to be inserted into a mating slot of a receiving portion of the firearm;

a bottom surface configured to interface with the receiving portion of the firearm;

a first feature extending from the bottom surface of the target sight and configured to interface with the receiving portion of the firearm, the first feature near a left side of the target sight;

a second feature extending from the bottom surface of the target sight and configured to interface with the receiving portion of the firearm, the second feature near a right side of the target sight opposite the left side;

a rear landing on a rear end of the target sight opposite the front end; and at least one fastener structured to clamp the rear landing to the firearm, thereby securing the target sight to the firearm, wherein the target sight is secured to the firearm without the use of a mounting plate.

23. The target sight according to claim 22, wherein the front end of the target sight is held to the firearm by mechanical interference of the lip and the mating slot.

24. The target sight according to claim 22, wherein the first and second features help to index the target sight to the receiving portion of the firearm.

25. The target sight according to claim 22, wherein the firearm is a pistol having a slide with the receiving portion.

26. The target sight according to claim 22, further comprising a threaded insert structured to receive the at least one fastener, in which the treaded insert is structured to increase surface area to distribute clamping force caused by the at least one fastener over the rear landing.

27. The target sight according to claim 22, wherein the lip is inserted into the mating slot of the receiving portion of the firearm by moving the target sight forward relative to the receiving portion.

28. The target sight according to claim 27, wherein, when the target sight is moved forward relative to the receiving portion, the first and second features are simultaneously inserted into corresponding features of the receiving portion.

29. The target sight according to claim 22 further comprising a light emitter structured to generate a point of aim.

* * * * *